US005674544A

United States Patent [19]

Shakspeare

[11] Patent Number: 5,674,544

[45] Date of Patent: Oct. 7, 1997

[54] COMPRESSIBLE INFUSION PACKAGE

[75] Inventor: Anthony Evan Shakspeare, Warnham, England

[73] Assignee: Tidy Tea Limited, St. Sampson, Channel Islands

[21] Appl. No.: 39,429

[22] PCT Filed: Oct. 10, 1991

[86] PCT No.: PCT/GB91/01762

§ 371 Date: Jun. 10, 1993

§ 102(e) Date: Jun. 10, 1993

[87] PCT Pub. No.: WO92/06903

PCT Pub. Date: Apr. 30, 1992

[30] Foreign Application Priority Data

| | | | |
|---|---|---|---|
| Oct. 10, 1990 | [GB] | United Kingdom | 9022013 |
| Jan. 21, 1991 | [GB] | United Kingdom | 9101285 |
| Feb. 13, 1991 | [GB] | United Kingdom | 9103027 |

[51] Int. Cl.[6] ..... B65B 29/04

[52] U.S. Cl. ..... 426/80; 426/77; 426/83

[58] Field of Search ..... 426/80, 77, 78, 426/81–84

[56] References Cited

U.S. PATENT DOCUMENTS

| | | | |
|---|---|---|---|
| 1,723,702 | 5/1929 | Mitchell . | |
| 1,775,347 | 9/1930 | Hirschhorn . | |
| 2,298,420 | 10/1942 | Salfisberg | 426/83 |
| 2,308,241 | 1/1943 | Hogaboom, Jr. . | |
| 2,335,159 | 11/1943 | Salfisberg | 426/83 |
| 2,359,271 | 9/1944 | Sidebotham . | |
| 2,364,903 | 12/1944 | Howard | 426/83 |
| 2,406,018 | 8/1946 | Irmscher | 426/83 |
| 2,466,281 | 4/1949 | Shaw . | |
| 2,468,464 | 4/1949 | Salfisberg | 426/83 |
| 2,791,505 | 5/1957 | Barnett . | |
| 2,869,718 | 1/1959 | Whelan | 426/83 |
| 2,878,927 | 3/1959 | Haley . | |
| 2,881,910 | 4/1959 | Murphy . | |
| 2,986,269 | 5/1961 | Goldberg . | |
| 3,047,397 | 7/1962 | Irmscher . | |
| 3,057,729 | 10/1962 | Grant . | |
| 3,092,242 | 6/1963 | Irmscher . | |
| 3,131,065 | 4/1964 | Salomon . | |
| 3,237,550 | 3/1966 | Christopher . | |

(List continued on next page.)

FOREIGN PATENT DOCUMENTS

| | | | |
|---|---|---|---|
| 1 654 971 | 4/1971 | Germany . | |
| 38 26 911 | 2/1990 | Germany . | |
| 61-104970 | 5/1986 | Japan | 426/83 |
| 910724 | 11/1962 | United Kingdom | 426/83 |
| WO 91/13580 | 9/1991 | WIPO . | |

OTHER PUBLICATIONS

Abstract of German Patent Specification No. 8707075.8.

Sydney Morning Herald "Not a drip, but he still couldn't win a prize," Oct. 3, 1990, Australia.

Manly Daily "His invention proves this man's no drip," Nov. 29, 1990, Australia.

*Primary Examiner*—Steven Weinstein

*Attorney, Agent, or Firm*—Bacon & Thomas

[57] ABSTRACT

The invention provides an infusion package comprising a closed bag (1) containing an infusible substance for infusion in a liquid, the bag being formed from panels (2,3) of porous material sealed together at their peripheral margins (4); and a pair of drawstrings (11, 12), each of which extends into the interior of the bag through a seal between the panels at a first location (13,14) on the peripheral margins, and extends across the interior of the bag to an anchoring point at a generally opposed location on the peripheral margins without any intermediate interengagement with the said panels of the bag; and wherein each drawstring is anchored by being held between two sealed together portions of the panels, the arrangement being such that pulling the drawstrings in generally opposite directions causes the bag to collapse, thereby to express liquid absorbed by the infusible substance during infusion. The infusion package is preferably a tea bag or coffee bag. The invention also provides a method for the manufacture of the infusion packages.

36 Claims, 3 Drawing Sheets

U.S. PATENT DOCUMENTS 3,316,686 5/1967 Welin-Berger .
3,346,388 10/1967 Andrews et al. ..... 426/82
3,396,032 8/1968 McCrae et al. ..... 426/83
3,415,656 12/1968 Lundgren .
3,539,355 11/1970 Kasakoff .
3,550,528 12/1970 O'Neill .
4,680,185 7/1987 Illk .
4,735,810 4/1988 Dacal .

COMPRESSIBLE INFUSION PACKAGE

FIELD OF THE INVENTION

This invention relates to infusion packages such as tea bags, and to methods for their manufacture.

DESCRIPTION OF RELATED ART

Tea bags are sealed soft porous bags containing tea leaves which are placed in cups, mugs or teapots of boiling water to produce a drink of tea. The bags can theoretically be of any shape, but are generally either rectangular or round. When the bags are placed in cups or mugs of boiling water, they are usually removed prior to the tea being drunk—this can also, although not necessarily, be the case when the bags are placed in the teapot. In the process of removing the bags either from the cup, mug or teapot, it is quite normal to squeeze the bags into a relatively dry state, usually by employing a kitchen utensil such as a teaspoon. Removal of excess liquid from the tea bag, in order to prevent the tea bag from dripping or leaving puddles of liquid on the surface with which it is in contact, is most desirable in view of the strongly staining nature of tea. However, a problem with using such kitchen utensils is that it is not easy to achieve efficient removal of excess liquid from the tea bag, and frequently the tea bag will have a tendency to drip even after it has been squeezed.

Numerous attempts have been made to overcome this problem, but the majority of such attempts have involved providing a means for applying an external pressure to the tea bag to squeeze out residual liquid. For example, it is known to provide a tea bag with a single tagged string which passes through a hole in an associated folded strip of card. After use, the tea bag is removed from the cup, mug or teapot by holding the tagged string in one hand, and the tea bag is then drawn up between the folded edges of the card which are then squeezed with the other hand to compress the tea bag and cause residual tea to be expressed therefrom. Such an approach is illustrated in, for example, U.S. Pat. Nos. 3,550,528, 3,057,729, 3,047,397 and 3,092,242. It has been found that a significant disadvantage of this approach is that residual tea is left on the folded card which consequently has a tendency to drip. Moreover the package is somewhat bulkier than is ideally desirable and, of course, the manufacture of the package is rendered somewhat more complex.

Another approach to this problem has been to provide a string harness around the tea bag, the string harness being tightened about the bag after use to squeeze liquid from the bag. Such an approach is illustrated by, for example, U.S. Pat. Nos. 3,237,550 and 2,881,910.

In U.S. Pat. No. 2,881,910, the bag is provided with two tagged pairs of drawcords which pass through the material of the tea bag from one face of the bag to the opposed face of the bag, and form a sling arrangement around the lower edge of the bag. After the teabag has been steeped in hot water for the desired length of time, the drawcords are pulled to fold the teabag in half and tighten the sling about the lower part of the bag thereby to squeeze out excess liquid. A disadvantage of such an arrangement is that the string tends to exert a very localised squeezing effect, and consequently does not efficiently express fluid from the bag. Moreover, the complexity of the string harness, and in particular the need for it to be sewn into the fabric of the bag, means that as a practical matter, it would be extremely difficult to produce such tea bags efficiently and economically on a large scale.

SUMMARY OF THE INVENTION

It is an object of the present invention to overcome the aforesaid problems by providing a tea bag which has means for efficient removal of excess liquid from the bag. In particular it is an object of the present invention to provide means for removing excess liquid from the tea bag such that the tea bag thereafter does not drip.

A further object of the present invention is to provide a tea bag having the aforesaid characteristics which can be manufactured efficiently on a large scale.

The present inventor has found that these objects can be met by providing a tea bag with drawstrings which are so arranged that when pulled, the tea bag collapses in on itself, the reduction in volume of the bag serving to force excess liquid out of the bag. Since it is the walls of the tea bag, rather than the string, which exert the main squeezing effect, liquid is expressed from the tea bag more efficiently than is the case when the string itself exerts the squeezing effect. Furthermore, the present inventor has also found that by arranging the drawstrings such that they are anchored in the sealed margins on one side of the bag, and pass through the interior of the bag and out through the sealed margins at an opposing side of the bag, without interengaging the side walls of the bag, the construction of the tea bag is considerably simplified. Such a construction avoids the need to sew the strings into the walls of the bag, for example as is the case with the tea hag disclosed in U.S. Pat. No. 2,881,910.

According to the present invention, there is provided an infusion package comprising a closed bag containing an infusible substance for infusion in a liquid, the bag being formed from panels of porous material sealed together at their peripheral margins; and a pair of drawstrings, each of which extends into the interior of the bag through a seal between the panels at a first location on the peripheral margins and extends across the interior of the bag to an anchoring point at a generally opposed location on the peripheral margins without any intermediate interengagement with the said panels; wherein each drawstring is anchored by being held between two sealed together portions of the panels, the arrangement being such that pulling the said drawstrings in generally opposed directions causes the bag to collapse, thereby to express liquid absorbed by the infusible substance during infusion.

The two drawstrings are preferably the two ends of a single continuous length of string, although separate lengths of string may be employed. The external ends of the drawstrings may be joined or may together form an integral loop of string extending from one point of entry into the bag to the other point of entry. However, it is preferred that the two drawstrings terminate separately externally of the bag. Preferably each drawstring is tagged.

It is preferred that the infusion package is constructed such that the drawstrings extend into the interior of the bag through sealed margins at spaced apart (e.g. opposed) locations on the margins. It is also preferred that the pair of drawstrings are anchored at points spaced apart along the said opposed location on the peripheral margins of the bag. The pair of drawstrings may cross over within the interior of the bag although this is not essential. Preferably the arrangement of the drawstrings is symmetrical about a plane of symmetry passing through the centre of the bag.

The bags may in theory be any shape or size, but typically they are rectangular or circular in plan. Although the bags may contain any infusible substance, it is envisaged that the invention will find its greatest application in relation to infusible substances for use in the preparation of beverages, and in particular to tea bags or coffee bags.

In general, the two drawstrings extending from the bag will be tagged to permit them to be gripped more firmly. One of the tags may be enlarged to form an envelope for the bag if so desired. Furthermore, one of the tags may be enlarged to form a platform upon which the used bag may be conveyed to a waste disposal container after use. Such a form of construction is envisaged as having application to tea and coffee bags in general and not merely to the collapsible bags of the present invention.

In a further aspect, the invention provides a method of preparing the infusion packages defined hereinabove, the method comprising providing two panels of porous material and positioning the panels in mutually confronting relationship, providing a string or strings and arranging the string or strings such that they are interposed between the two confronting panels; and sealing the panels together so as to form the porous bag; the infusible substance being disposed between the panels prior to final closure of the bag.

It will be appreciated from the foregoing that the present invention provides an infusion package such as a tea bag which is provided with two string type attachments which, in use, hang freely over the lip of a cup, mug or tea pot containing the bag. After use, the two attachments can then be used to remove the tea bag from the mug, cup or teapot by lifting them up and simultaneously pulling them in generally opposite lateral directions. The pulling of the attachments in generally opposite lateral directions will cause the bag to collapse thus squeezing the tea bag into a relatively dry state. Thus the use of the said two attachments will eradicate totally the requirement for any other external utensil either to lift out or squeeze the tea bag into a relatively dry state.

BRIEF DESCRIPTION OF THE DRAWINGS

The invention will now be illustrated in more detail by reference to the accompanying drawings in which.

DETAILED DESCRIPTION OF THE PREFERRED EMBODIMENTS

Figure 1:
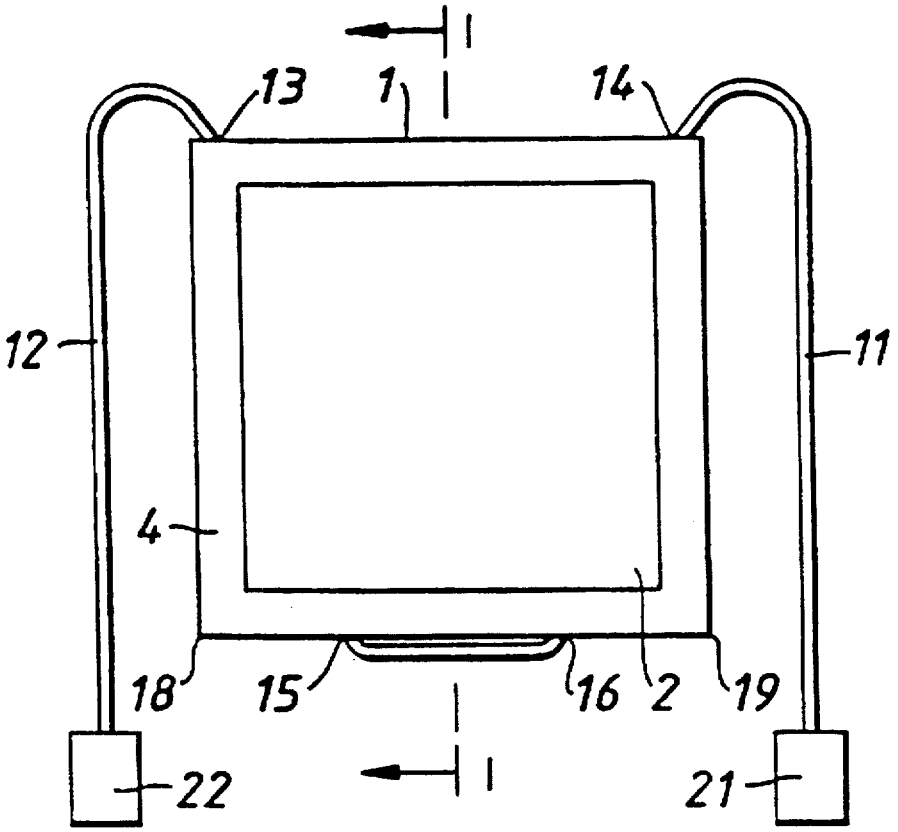
FIG. 1 is a plan view of the tea bag.
Figure 2:
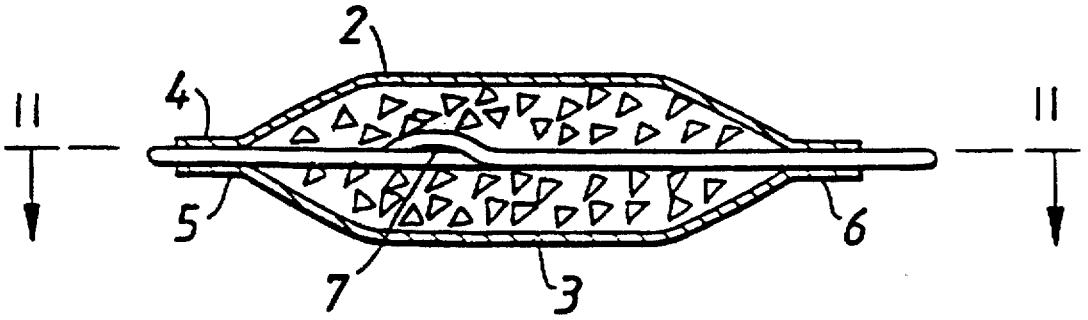
FIG. 2 is a side sectional view along line AA in FIG. 1.
Figure 3:
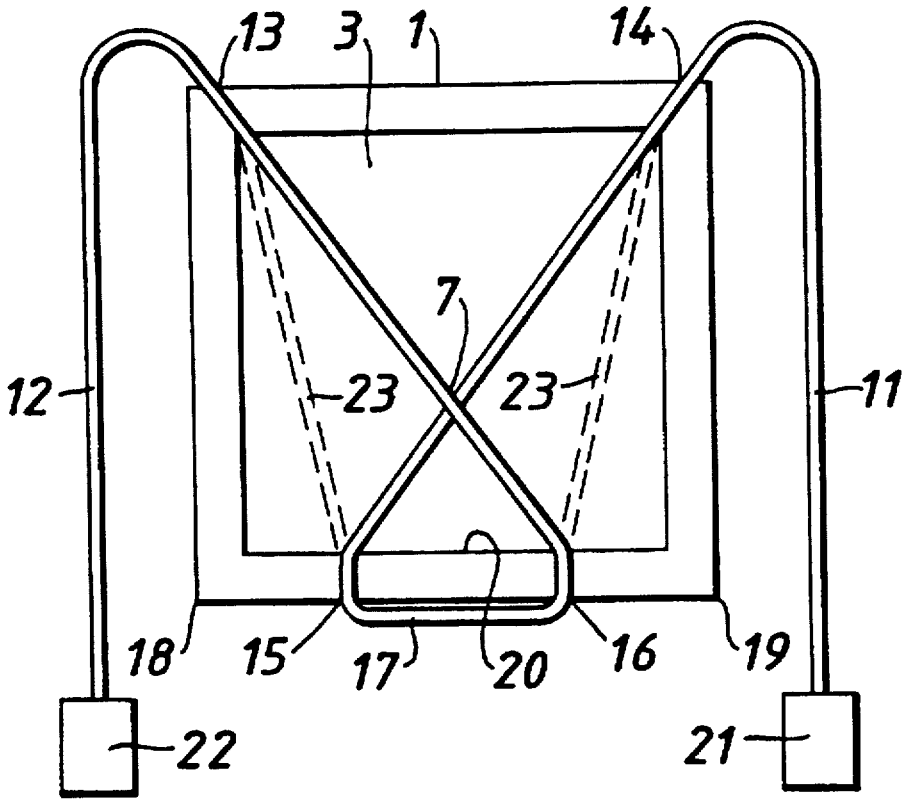
FIG. 3 is a front sectional view along lines BB in FIG. 2.

Referring now to the Figures, it can be seen from FIGS. 1 and 2 that the tea bag is of generally rectangular shape comprising a bag 1 formed of a generally porous material of the type conventionally used for tea bags. The tea bag is formed from two panels 2 and 3 of porous material heat sealed together at sealed margins 4 around its periphery. Extending from adjacent corners 13 and 14 of the tea bag are draw strings 11 and 12, to the ends of which are attached tags 21 and 22. As is shown in FIG. 3, the drawstrings 11 and 12 pass through the sealed margins 4 between panels 2 and 3 into the interior of the tea bag. Inside the tea bag, the strings pass from one side 5 to the other side 6 crossing over at point 7 and are anchored in the opposite sealed margin 6. The string enters the sealed margin 6 at point 16, forms a loop extending along the edge of the bag and re-enters the interior of the bag through the margin 6 at point 15.

The arrangement of the string is illustrated in more detail in FIG. 3. Here it can be seen that strings 11 and 12 are in fact the two ends of a single continuous piece of string. The string enters the bag through the sealed margin at point 13 and runs in approximately diagonal fashion across the interior of the bag to point 16 before passing out through the sealed margin and along the edge of the tea bag to define a loop section 17. The string re-enters the bag through the sealed margin at 15 and then passes through the interior of the bag, crossing over itself at point 7 before passing out through the sealed margin again at point 14, to form drawstring 1. It can be seen that at no point is the string interengaged with either panel 2 or panel 3 of the tea bag.

Figure 7B:
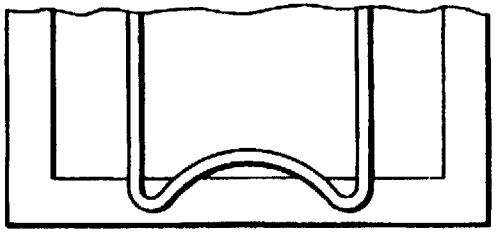
FIGS. 7*a* and 7*b* are partial sectional views illustrating alternative methods of anchoring the drawstrings in the sealed margins.
Figure 7A:
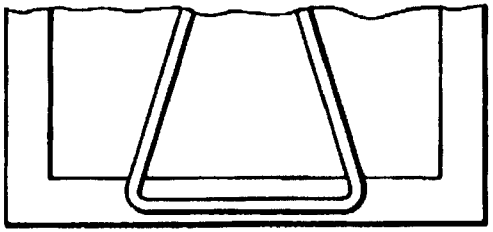

In an alternative arrangement, the length of string 17, which is shown in FIG. 3 as forming a loop along the external edge of the bag, can be retained entirely within the sealed margin 6, as is illustrated in FIG. 7*a*. The loop may also lay along the interior of the bag, as is shown in FIG. 7*b*. As a further variation on the arrangement shown in FIG. 3, the string, rather than extending between points 13 and 16, and between points 14 and 15 so as to define a crossover point 17, may be arranged as illustrated by the dotted line 23. Thus the string can traverse the interior of the bag between points 13 and 15, and between 14 and 16.

The length of the looped section 17, can vary in that points 15 and 16 can be located at any point between the midpoint 20 and the corners 18 and 19 of the tea bag. However, it is preferred that points 15 and 16 are spaced equidistantly from the midpoint 20. In general, for both rectangular and circular bags (or indeed bags of any other shape), it is preferred that the arrangement of the string is symmetrical about a plane of symmetry running through the centre of the bag.

Figure 4:
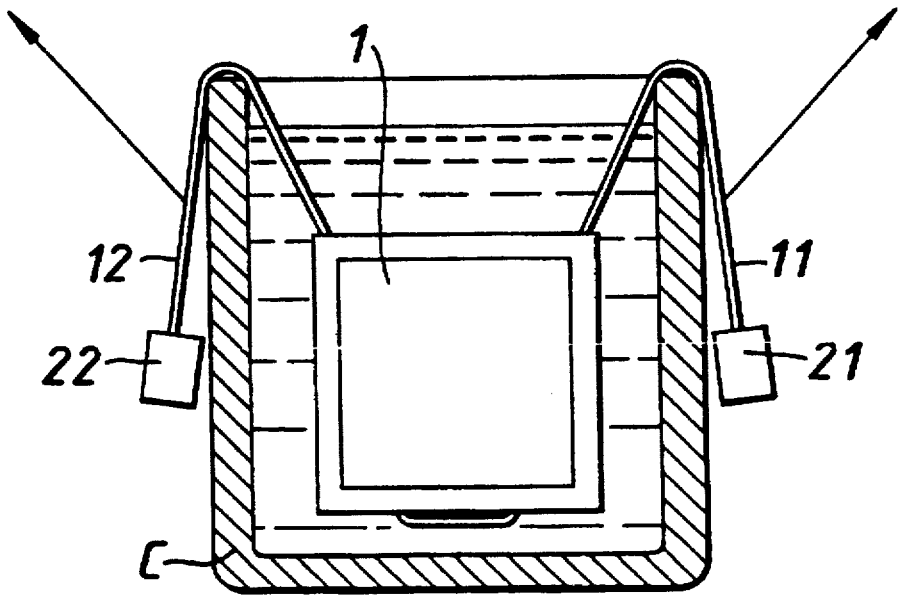
FIG. 4 is a side elevation in section of a container such as a cup containing the tea bag of FIGS. 1 to 3.

In use, the tea bag is inserted into a cup, mug or pot, and the two tags 21 and 22 are then hung freely over the opposing lips of the cup, mug or teapot C as illustrated in FIG. 4. When it is adjudged that the tea bag has been steeped in the water for a sufficiently long period of time, the two tags are pulled in opposed directions as illustrated by arrows in FIG. 4. This has the effect of causing the tea bag to collapse inwardly towards its centre, thus squeezing most of the liquid in the tea bag out of the bag, whilst simultaneously withdrawing the tea bag from the cup, mug or teapot. The result is a relatively dry tea bag which does not thereafter drip or leave puddles of tea on any surface with which it comes into contact.

Although the string is sealed into the margins at points 13 and 14, it should be noted that when pulled in the manner described above, the string will pull through the seal. However, the string remains anchored at positions 15 and 16, thanks to the external loop 17 which serves to ensure that the string does not pull through the sealed margin 6. In an alternative arrangement, the loop 17 may be retained entirely within the sealed margin, and need not be in the form of an external loop, provided that the margin is wide enough and the seal sufficiently strong to ensure that the loop 17 does not pull through.

Figure 5:
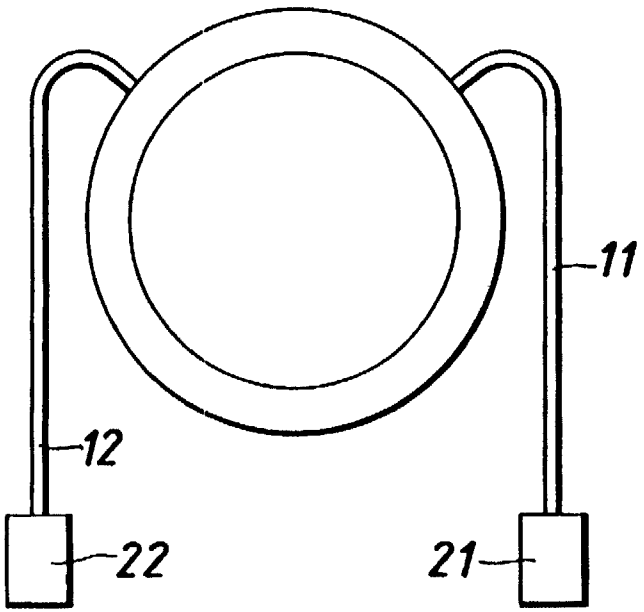
FIG. 5 is a round tea bag according to the invention.

Turning now to FIG. 5, this Figure illustrates a tea bag constructed in a manner similar to that of the tea bag illustrated in FIGS. 1 to 4, except that it is round rather than rectangular.

Figure 6:
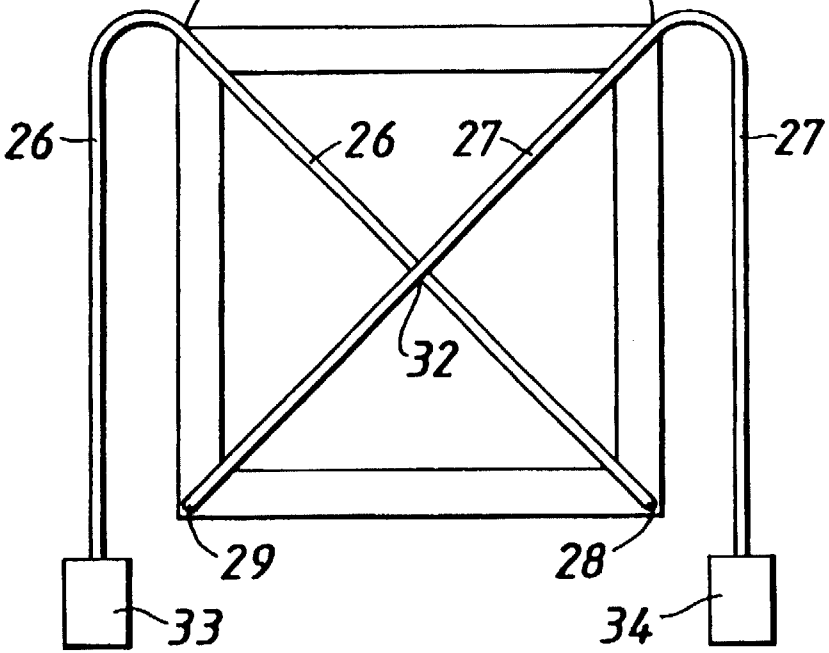
FIG. 6 is a sectional view through a further embodiment of a rectangular tea bag according to the invention.

FIG. 6 illustrates a view in section of a rectangular tea bag similar to the embodiment shown in FIGS. 1 to 4 except that the arrangement of the drawstrings differs slightly. In this embodiment, there are provided two separate drawstrings 26 and 27 which are anchored in the sealed margins at adjacent corners 28 and 29. The two strings 26,27 traverse the interior of the tea bag from their respective anchoring points 28,29 to the respective diagonally opposite corners 30,31 crossing over at point 32. The strings 26,27 pass through the sealed margins in the manner described above in relation to FIGS. 1 to 5 and terminate in tags 33,34.

In each of the rectangular tea bags illustrated, the drawstrings are shown as passing through the sealed margins at adjacent corners. However, it will be appreciated that it is not essential that the drawstrings should pass through the sealed margin at the exact locations of the corners. They could, for example, pass through the margin at locations displaced from, but near to, the corners.

The tea bags of the present invention differ from tea bags of the type disclosed in U.S. Pat. No. 2,881,910 in that the arrangement of the drawstrings is such that when pulled, they cause the tea bag to collapse into itself, and thus it is the walls of the tea bag itself which provide the squeezing action on the tea leaves within the bag. This is in contrast to known tea bags of the type described hereinabove which have string harnesses designed to encircle the tea bag such that the compression force on the tea leaves is exerted mainly by the string itself, rather than the tea bag casing as a whole.

It is contemplated that an advantageous property of the tea bags of the present invention is that they will lend themselves to efficient manufacture on a large scale. Conventional tea bag manufacture involves the use of continuous webs of porous material, and, in one known process, a single web of porous material is gradually folded in half and then heat sealed along a line transverse to the fold to form a pocket into which tea is inserted. The sides of the pocket are then heat sealed in like fashion and the completed tea bag is then cut from the web or perforated to allow subsequent separation. In another method of manufacturing tea bags, two continuous webs of porous material are brought together and are heat sealed together The method of preparing the tea bags of the present invention can be substantially the same as outlined above in respect of conventional tea bags, but will differ in that the drawstring or strings is or are laid into the space between the two individual webs or the two halves of the folded over web prior to the heat sealing steps. Such a modification is of course simpler than sewing the drawstring into the tea bag casing as would be required with the tea bags illustrated in U.S. Pat. No. 2,881,910.

The embodiments illustrated in the drawings are for the purposes of exemplification only, and it will be readily apparent to the skilled man that numerous modifications and alterations may be made to the illustrated tea bags without departing from the principles underlying the present invention. All such modifications and alterations are intended to be embraced by the scope of this invention, which is limited only by the scope of the appended Claims.

I claim:

1. An infusion package comprising a closed bag containing an infusible substance for infusion in a liquid, the bag being formed from panels of porous material having peripheral margins at which said panels are sealed together, said bag having an interior chamber formed between said panels and within said peripheral margins, within which said infusible substance is contained; and a pair of drawstrings, each of which extends into the interior of the bag through a seal between the panels at spaced apart entry points on the peripheral margins, and extends across the interior chamber within which said infusible substance is contained to an anchoring point at a generally opposed location from said entry points on the peripheral margins without any intermediate interengagement with said panels of the bag; wherein each drawstring is anchored by being held by said seal between two sealed together portions of the panels at said anchoring point, the arrangement being such that pulling the drawstrings in generally opposite directions causes the drawstring to move through said seal at said spaced apart entry points and relative to the panels, while being held at the anchoring point so as to cause the bag to collapse, thereby to express liquid absorbed by the infusible substance during infusion.

2. An infusion package according to claim 1 wherein the pair of drawstrings are the two ends of a single continuous length of string.

3. An infusion package according to claim 2 wherein one said anchoring point and the other said anchoring point are spaced apart along the peripheral margins and are linked by a portion of the single continuous length of string which forms a loop of string lying outside the seal.

4. An infusion package according to claim 2 wherein one said anchoring point and the other said anchoring point are linked together by a portion of the single continuous length of string which is held entirely between two sealed together portions of the panels.

5. An infusion package according to claim 1 wherein the drawstrings extend into the interior of the bag at spaced apart locations on the peripheral margins.

6. An infusion package according to claim 1 wherein one said anchoring point is spaced apart along the peripheral margins of the bag from the other said anchoring point.

7. An infusion package according to claim 1 wherein the drawstrings are arranged to be symmetrical about a plane of symmetry running through the centre of the bag.

8. An infusion package according to claim 1 which is rectangular or circular in plan.

9. An infusion package according to claim 8 which is rectangular in plan and wherein the drawstrings extend into the interior of the bag at or near adjacent corners of the bag.

10. An infusion package according to claim 1 wherein the panels of porous material are sealed together around substantially the entirety of their peripheral margins.

11. An infusion package according to claim 1 wherein the panels are defined by integral portions of a single piece of porous fabric.

12. An infusion package according to claim 1 wherein the panels of porous material are sealed together by means of heat seals.

13. An infusion package according to claim 1 wherein the drawstrings have tagged ends.

14. An infusion package according to claim 1 wherein the infusible substance is tea or coffee.

15. A method of preparing an infusion package comprising a closed bag containing an infusible substance for infusion in a liquid, said method comprising forming the bag from panels of porous material having peripheral margins, said bag having an interior chamber formed between said panels and within said peripheral margins, placing said infusible substance in said interior chamber, and wherein prior to said sealing said panels, positioning a pair of drawstrings relative to said bag such that each extends into the interior of the bag through a seal between the panels at spaced apart entry points on the peripheral margins, and extends across the interior chamber within which said infusible substance is contained to an anchoring point at a generally opposed location from said entry points on the peripheral margins without any intermediate interengagement with said panels of the bag, said sealing said panels anchoring each drawstring such that each is anchored by being held by said seal between two sealed together portions of the panels at said anchoring point, the arrangement being such that pulling the drawstrings in generally opposite directions causes the drawstring to move through said seal at said spaced apart entry points and relative to the panels, while being held at the anchoring point so as to cause the bag to collapse, thereby to express liquid absorbed by the infusible substance during infusion.

16. A method according to claim 15 wherein the porous material is in the form of a single sheet, which is folded in half, each half defining one panel.

17. A method according to claim 15 wherein each panel is a discrete sheet of porous material.

18. A method according to claim 16 or claim 17 wherein the sheet of porous material forms part of a web of such sheets linked together.

19. An infusion package comprising a porous closed bag containing an infusible substance for infusion in a liquid, the bag being formed from front and rear panels having peripheral margins which are heat sealed together; a pair of drawstrings extending into the interior of the bag through the sealed margins between the front and rear panels; each of the pair of drawstrings extending across the interior of the bag from one sealed margin to a generally opposed sealed margin without any intermediated interengagement with the front and rear panels; and being anchored at an anchoring point in the opposed sealed margin; the arrangement being such that pulling the drawstring ends in generally opposite directions causes the drawstrings to move through the sealed margins and relative to the panels while held at the anchoring point so as to cause the bag to collapse, thereby to express liquid absorbed by the infusible substance during infusion.

20. An infusion package comprising a closed bag containing an infusible substance for infusion in a liquid, the bag being formed from panels of porous material having peripheral margins at which said panels are sealed together, said bag having an interior chamber within which said infusible substance is contained; and having a length of string disposed within said interior chamber, the length of string having two ends constituting a pair of drawstrings which extend out to the bag exterior through a seal between the panels at spaced apart locations on the peripheral margins, each of said drawstrings extending across the interior chamber within which said infusion substance is contained to an anchoring point at a generally opposed location on the peripheral margins with respect to said spaced apart locations without penetrating the panels of porous material, the anchoring point being defined by a sealed region at which said panels are sealed together, the string being anchored at said anchoring point by being arranged to extend between the panels in a loop around said sealed region, the arrangement being such that pulling the drawstrings in generally opposite directions causes the string to move through said seal at said spaced apart locations and relative to the panels while being held at the anchoring point so as to cause the bag to collapse thereby to express liquid absorbed by the infusible substance during infusion.

21. An infusion package according to claim 20 wherein the drawstrings are arranged to be symmetrical about a plane of symmetry running through the center of the bag.

22. An infusion package according to claim 20 which is rectangular or circular in plan.

23. An infusion package according to claim 20 wherein the panels of porous material are sealed together around substantially the entirety of their peripheral margins.

24. An infusion package according to claim 20 wherein the drawstrings have tag ends.

25. An infusion package according to claim 20 wherein the infusible substance is tea.

26. An infusion package comprising a closed bag containing an infusible substance for infusion in a liquid, the bag being formed from panels of porous material having peripheral margins at which said panels are sealed together, said bag having an interior chamber within which said infusible substance is contained, and a pair of drawstrings, each of which extends into the interior of the bag through a portion of said seal between the panels on the peripheral margins, and extends across the interior chamber of the bag to an anchoring point at a generally opposed location on the peripheral margins without penetrating said panels of the bag; wherein each drawstring is anchored at said anchoring point by being held between two sealed together portions of the panels, the arrangement being such that pulling the drawstrings in generally opposite directions causes the drawstrings to move through said portion of said seal and relative to the panels while being held at the anchoring point so as to cause the bag to collapse, thereby to express liquid absorbed by the infusible substance during infusion.

27. An infusion package according to claim 26 wherein the pair of drawstrings are the two ends of a single continuous length of string.

28. An infusion package according to claim 27 wherein one said anchoring point and the other said anchoring point are spaced apart along the peripheral margins and are linked by a portion of the single continuous length of string which forms a loop of string lying outside the seal.

29. An infusion package according to claim 27 wherein one said anchoring point and the other said anchoring point are linked together by a portion of the single continuous length of string which is held entirely between two sealed together portions of the panels.

30. An infusion package according to claim 26 wherein the drawstrings extend into the interior of the bag at spaced apart locations on the peripheral margins.

31. An infusion package according to claim 26 wherein one said anchoring point is spaced apart along the peripheral margins of the bag from the other said anchoring point.

32. An infusion package according to claim 26 wherein the drawstrings are arranged to be symmetrical about a plane of symmetry running through the center of the bag.

33. An infusion package according to claim 26 which is rectangular or circular in plan.

34. An infusion package according to claim 26 wherein the panels of porous material are sealed together around substantially the entirety of their peripheral margins.

35. An infusion package according to claim 26 wherein the drawstrings have tagged ends.

36. An infusion package according to claim 26 wherein the infusible substance is tea.

* * * * *